US005683085A

United States Patent [19]

Johnson et al.

[11] Patent Number: 5,683,085

[45] Date of Patent: Nov. 4, 1997

[54] CARD HANDLING APPARATUS

[76] Inventors: Rodney George Johnson; Mark William Piacun; Clarence Ernest Rudd, all of P.O. Box 231, Robina, Australia, QLD 4226

[21] Appl. No.: 467,309

[22] Filed: Jun. 6, 1995

[51] Int. Cl.[6] ..... A63F 1/12

[52] U.S. Cl. ..... 273/149 R

[58] Field of Search ..... 273/149 R

[56] References Cited

U.S. PATENT DOCUMENTS 4,513,969 4/1985 Samsel, Jr. ..... 273/149 R 5,382,024 1/1995 Blaha ..... 273/149 R

*Primary Examiner*—Benjamin H. Layno

*Attorney, Agent, or Firm*—Hoffman, Wasson, & Gitler, P.C.

[57] ABSTRACT

Apparatus for shuffling or handling cards including a chamber in which a main stack of cards are supported, a loading station for holding a secondary stack of cards, and card separating mechanism for separating cards at a series of positions along the main stack to allow the introduction of cards from the secondary stack into the main stack at those positions. The separating mechanism grips cards at the series of positions along the stack and lifts those cards to define spaces in the main stack for introduction of cards from the secondary stack.

23 Claims, 6 Drawing Sheets

CARD HANDLING APPARATUS

TECHNICAL FIELD

This invention relates to card handling apparatus which in one particular aspect is designed for use in shuffling playing cards.

BACKGROUND ART

In establishments where cards are played, say for the purposes of gambling, a number of packs of cards are usually employed for each table where a card game, such as blackjack is played. The cards are normally shuffled by hand and then placed in a shoe or other device from which cards may be withdrawn by a dealer one at a time. Shuffling cards by hand is obviously time consuming and labour intensive and additionally often does not ensure full and even mixing, of cards. Additionally a large number of packs of cards, often up to six packs or more, are used at each table on each day and those packs are then discarded at the end of the day. An apparatus has been provided in the past to facilitate shuffling of cards, however, such apparatus tends only to shuffle cards in the same way as achieved manually. Such apparatus is very expensive and has not proved particularly effective.

SUMMARY OF THE INVENTION

The present invention aims to overcome or at least alleviate one or more of the above disadvantages by providing card handling apparatus which may be applied to the shuffling of cards for use in card games, such as gambling games. The present invention further aims to provide apparatus which operates efficiently in a card shuffling application. Other objects and advantages of the invention will become apparent from the following description.

The present invention thus provides in one aspect, card handling apparatus, said apparatus including:

means for supporting a main stack of cards;

means for separating said cards at positions along said stack;

means for introducing respective cards into said stack at respective said positions; and means for removing cards from said stack for dispensing thereof.

Preferably a loading station is provided for supporting further cards in a further or secondary stack, or individually, for introduction into the main stack for subsequent dispensing. Means are suitably provided for moving the further cards or the respective cards or card at one end, usually the lowermost card, of the further stack into the main stack. Such means may include a roller or rollers which engages or may engage the further card or lowermost card in the further stack such that when the roller or rollers are rotated the further card or lowermost card in the further stack is displaced towards the main stack. Alternatively a pusher may be used to displace the cards from the further stack. A further pair of opposed co-operating rollers may be arranged to engage the displaced card and introduce it into the main stack.

At the card removal position from the main stack, a further roller or rollers may be provided to displace the lowermost or end card from the main stack. The main stack may be supported on the further roller or roller such that when the further roller or rollers is or are rotated, the lowermost or end card is displaced from the main stack. A further pair of opposed cooperating rollers or pairs of opposed cooperating rollers may be provided for grasping the displaced lowermost or end card and feeding it from the main stack for dispensing.

Means are provided for "cutting" or separating the cards in the main stack at random or non random positions along the stack to permit insertion of the card from the loading station into the main stack at the cut or separation position. Cutting or separation of the cards may be achieved by means of a gripping or moving mechanism which is movable to a series of positions along the main stack at which it is actuated to grip cards in the main stack or extend into the main stack and separate the cards at that position from the remainder of the cards in the stack. Preferably the main stack is arranged vertically and the gripping or moving mechanism is arranged to grip or engage cards at a series of spaced vertical positions along the main stack and lift or move those cards and any cards located above those cards to define a space between the remainder of the cards for receipt of the card introduced from the loading station. As an alternative to the gripping mechanism, pins or thin elements may be inserted at the series of positions along the stack to split the cards at the position of insertion and thereafter lift the cards above or one side of the pins or elements to allow insertion of cards from the loading station.

The gripping or moving mechanism may be supported for movement with an endless belt which is driven in opposite directions, to move it along the stack. The gripping or moving mechanism may be supported for sliding movement along a guide track. The gripping or moving mechanism may include a pair of arms which are adapted to be located on opposite sides of the stack and supported for movement transversely of the stack. The gripping arms may be movable by means of a solenoid to cause them to grip or split the cards. For this purpose the gripping arms may be supported on respective slides and the solenoid may have its body supported on one slide and its actuator or armature connected to the other slide. The ends of the gripping arms may be provided with pads to enable gripping of cards in the stack or alternatively, pins or thin elements for insertion into the stack.

The positions at which the gripping or moving mechanism engages with the cards in the main stack may be determined randomly or alternatively may be a series of set positions along the stack. Control means preferably programmable control means may be provided to move the gripping or moving mechanism to set or random positions along the stack before the gripping or moving mechanism is actuated to grip or engage with the cards. In a particularly preferred form, the gripping mechanism is moved to eleven set positions along the stack however there may be any number of set positions or as stated above the positions may be randomly selected positions. The set positions may be defined by respective sensors which define the set positions along the stack. For example, a light sensor may be moveable with the gripping and moving mechanism and an apertured member provided in a fixed position adjacent the light sensors. The apertured member may include a plurality of spaced apart apertures arranged longitudinally of the stack whereby when the light sensor is moved into alignment with respective apertures, the sensing of light thereby causes the gripping mechanism to stop and be actuated to grip the cards at that position. Alternatively, the motor which moves the mechanism along the stack may be controlled such as to stop the mechanism at the positions along the stack.

Preferably respective sensors are provided in the apparatus to sense the presence or absence of cards at certain locations such as at the loading station and at the dispensing station and to cause actuation of mechanisms and motors of the apparatus in accordance with sensed conditions of the sensors. The control means may be used to control the apparatus in accordance with conditions sensed by the sensors.

Whilst the apparatus of the invention is particularly suited to dispensing cards one at a time, the apparatus may be modified to shuffle and supply a single or multiple packs of shuffled cards at the dispensing station.

BRIEF DESCRIPTION OF THE DRAWINGS

In order that the invention may be more readily understood and put into practical effect, reference will now be made to the accompanying drawings which illustrate a preferred embodiment of the invention and wherein.

DETAILED DESCRIPTION OF THE PREFERRED EMBODIMENT

Figure 1:
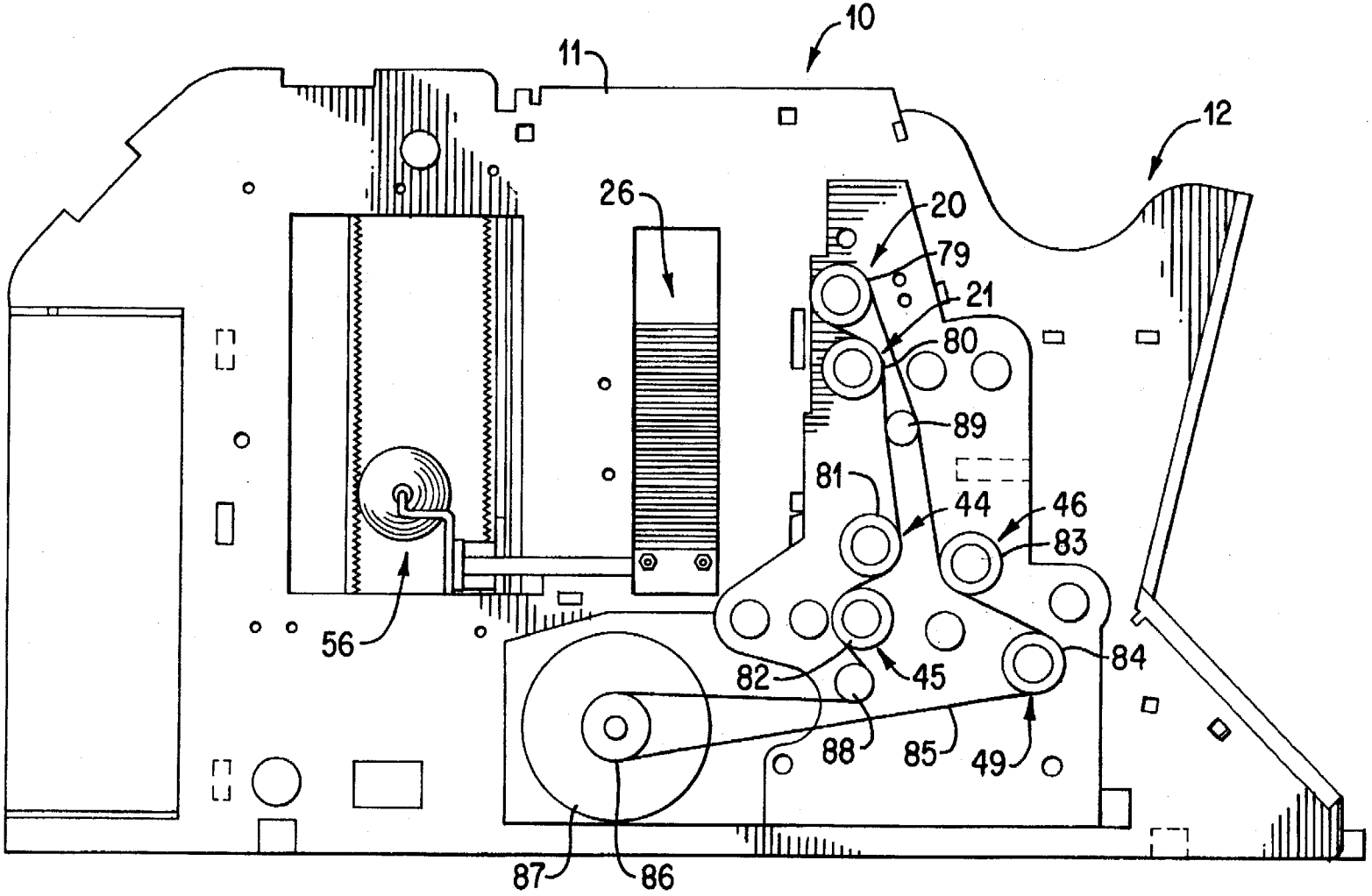
FIG. 1 is a side elevational view of the apparatus according to the invention.
Figure 2:
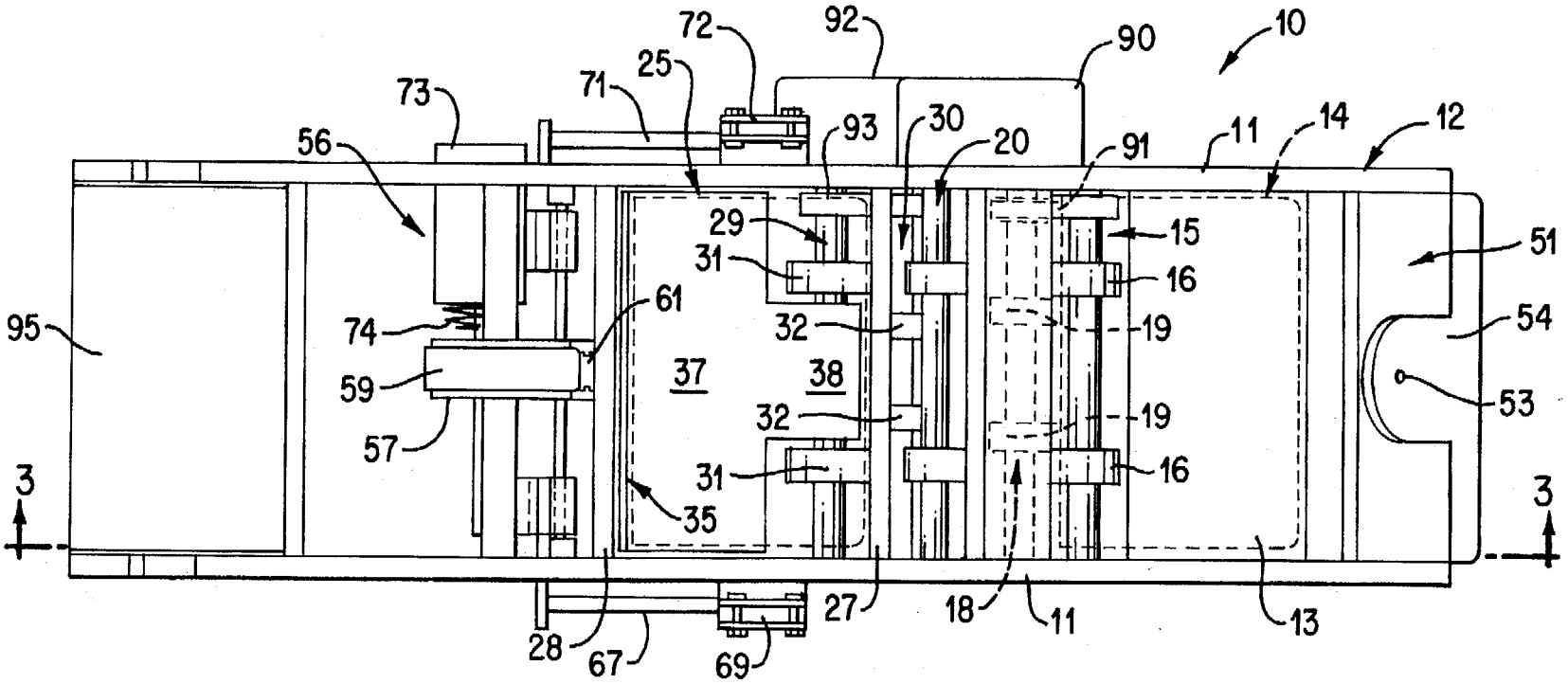
FIG. 2 is a plan view of the apparatus of FIG. 1.
Figure 3:
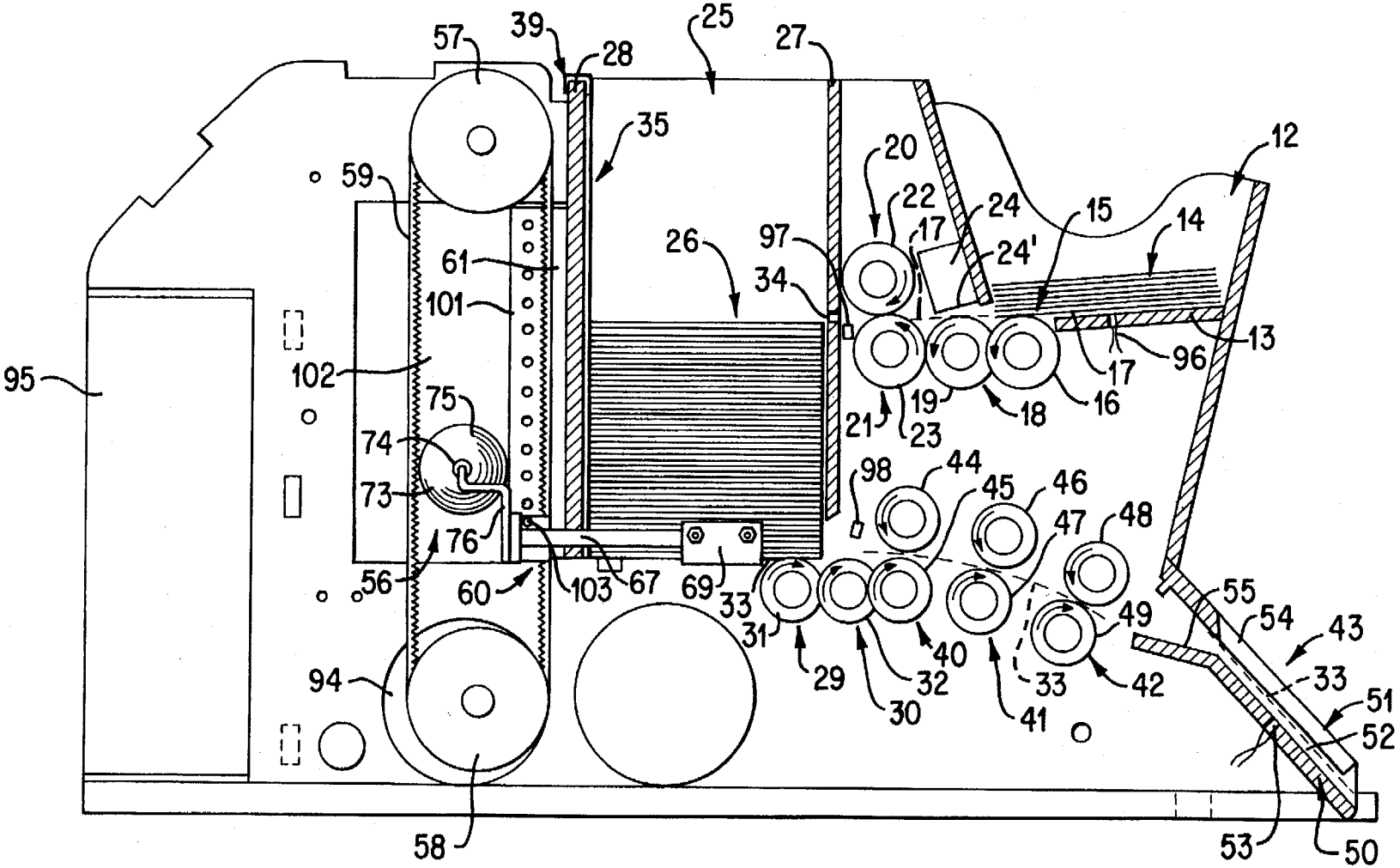
FIGS. 3 is a sectional elevational view of the apparatus along line A—A of FIG. 2 but showing the card gripping arm.

Referring to the drawings and firstly to FIG. 1 there is illustrated card handling apparatus 10 according to the present invention which in this embodiment is applied to the shuffling and handling of cards for use in card game applications. The apparatus 10 includes a pair of opposite upright spaced apart planar side walls 11 defining a loading station 12 which as shown in FIG. 3, includes a planar platform or base 13 upon which individual cards or a stack of cards 14 may be at least partially seated or placed. The loading station 12 also includes a first roller assembly 15, including spaced apart rollers 16 located forwardly of the platform 13 upon which cards placed into the station 12 also seat. When driven, the roller assembly 15 causes the card 17 seated on and in contact with the rollers 16 (which may be the lowermost card in the stack 14) to be displaced out of the loading station 12.

A further roller assembly 18 located forwardly of the roller assembly 15 is also rotated at the same time as the roller assembly 15. This roller assembly 18 includes spaced apart rollers 19 located between the rollers 16 of the assembly 15 and serves to further assist in withdrawing the card 17 from the loading station 12. A pair of opposed contra-rotatable roller assemblies 20 and 21, which have respective pairs of aligned rollers 22 and 23 with their peripheries engaging or located adjacent to each other to define a nip, are arranged forwardly of the loading station 12. The roller assemblies 20 and 21 are adapted, when driven, to grasp therebetween the lowermost or displaced card 17 as it is moved outwardly by the roller assemblies 15 and 18 and draw it fully from the loading station 12.

A pair of deflecting members 24 are provided on inner side of the opposite side walls 11 and in the path of movement of the displaced card 17. The deflecting members 24 which may simply comprise blocks of plastics material or other material, define downwardly inclined surfaces 24' which when engaged by the card 17 direct the card 17 downwardly towards the lower rollers 23 of the roller assembly 21 as shown in dotted outline in FIG. 3 which when rotated anti-clockwise, directs the card 17 towards the nip of the opposed roller assemblies 20 and 21 to facilitate its engagement by the rollers. This arrangement ensures that only one card at a time is fed from the loading station 12 as cards above the lowermost card 17 slid out through frictional engagement with the card 17 which is below it, will be blocked by engaging the deflecting members 24.

The apparatus 10 further includes a main shuffling chamber 25 for supporting an upright stack 26 of cards to be shuffled as described further below. The chamber 25 includes front and rear walls 27 and 28 which extend between the opposite side walls 11 and define a chamber 25 having a cross section slightly greater than the perimeter size of the cards so that the latter may locate neatly therein. The chamber 25 also has at it lower end two roller assemblies 29 and 30, the first assembly 29 comprising a pair of spaced apart rollers 31 and the second set 30 comprising a further pair of spaced apart rollers 32 located axially inwardly of the rollers 31. The stack 26 of cards is arranged to seat on the rollers 31 which when operated serve to displace the lowermost card 33 in the stack 26 in a similar manner to that which occurs with the loading station 12. The front wall 27 also includes a transverse slot 34 aligned with the nip of the roller assemblies 20 and 21 through which cards from the loading station 12 pass into the chamber 25.

Figure 4:
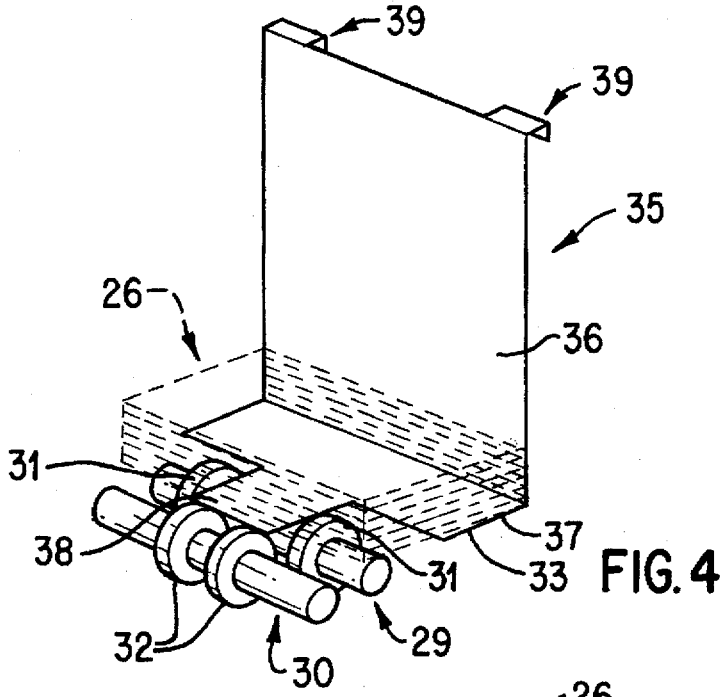
FIG. 4 illustrates a card supporting device for use in the main stacking chamber of the apparatus of FIG. 1.

The stack of cards 26 may also be supported within the chamber 25 on a removable support bracket 35. The bracket 35, shown more clearly in FIG. 4, includes a side plate 36 and a bottom plate 37 extending at right angles to the plate 36 on which the cards 26 seat. A tongue 38 extends forwardly of the bottom plate 37. The upper end of the side plate 36 may include hooks 39 which hook over the wall 28 so that the bracket 35 may be suspended in position. When the bracket 35 is within the chamber 26, the tongue 38 is located between the rollers 31 but slightly below the upper periphery thereof such that the lowermost card 33 in the stack 26 sits on the rollers 31 and plate 37 and may be displaced when the roller assembly 29 and thus rollers 31 are rotated. The rollers 32 also assist in removing the card 33 from the stack 26 when the card 33 is displaced and moved into contact therewith. The bracket 35 may be lifted from the chamber 25 to allow removal of cards or a stack of cards within the chamber 25.

Three sets of roller assemblies 40, 41, and 42 are provided for gripping the lowermost card 33 displaced from the stack 26 and feeding it for presentation to the dealer at a dispensing station 43. Each roller assembly 40, 41, and 42 includes upper and lower pairs of opposed rollers 44 and 45, 46 and 47, and 48 and 49, respectively. The pairs of rollers have their peripheries located adjacent each other and are adapted to co-operate with, and grip respective cards. At least one roller in each pair is capable of being driven as described further below.

The dispensing station 43 includes a downwardly inclined lower wall 50 and a spaced part inclined substantially parallel upper wall 51 which define a slot 52 into which cards (shown in dotted outline in FIG. 3) are dispensed The lower wall 50 carries a sensor 53, preferably a light sensor, which senses the presence or absence of a card in the dispensing station 43. The upper wall 51 also includes a downwardly open slot 54 which enables a finger or fingers to be inserted to engage the card located in the slot 52 and resting on or adjacent the lower wall 50 and facilitates movement of the card from that position. A further wall 55 joins the wall 50 to define a throat to assist in directing the card into the dispensing station 43 from the roller assemblies 40, 41 and 42.

Figure 5:
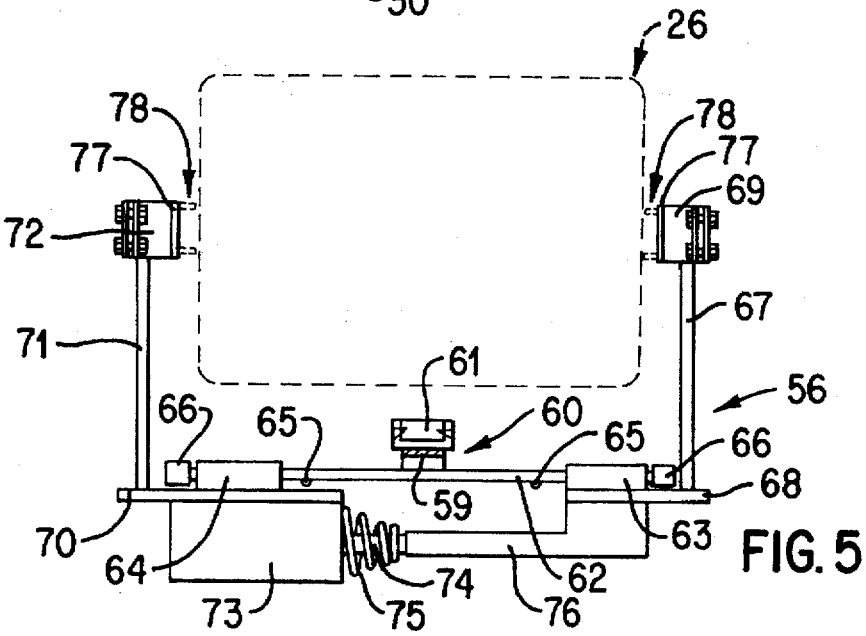
FIG. 5 is a plan view of a preferred form of gripping mechanism for the apparatus of the invention.
Figure 6:
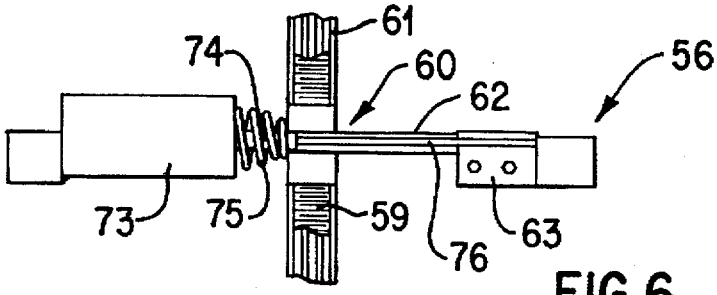
FIG. 6 is a front view of the gripping mechanism of FIG. 5.

Associated with the chamber 25 is a card gripping mechanism 56 shown also in FIGS. 5 and 6 which includes a pair of spaced apart upper and lower rollers 57 and 58 on one side of the chamber 25 about which an endless belt 59 is supported. The rollers 57 and 58 may comprise toothed rollers and the belt 59 may comprise a toothed belt for cooperation with the teeth on the rollers 57 and 58. A carriage 60 is fixed, to the belt 59 for movement therewith and arranged for sliding movement along a guide track 61 fixed in an upright attitude on the outer side of the rear wall 28 of the chamber 25.

The carriage 60 supports a cross arm 62 which carries two slides 63 and 64 which are constrained for sliding movement between respective spaced stops 65 and 66 at opposite ends of the arm 62. One gripping arm 67 is connected to one slide 63 through a bracket 68 and has a gripping member 69 at its outer end. The other slide 64 also supports through a bracket 70, a further gripping arm 71 having a gripping member 72 at its outer end. The bracket 70 additionally supports a solenoid 73 having an actuator or armature 74 which is spring loaded by means of a spring 75 to an extended position. An arm 76 connects the actuator 74 and slide 63.

In operation, and when cards in the stack 26 (shown in dotted outline in FIG. 5) are required to be gripped and lifted, current is supplied to the solenoid 73 to retract the actuator 74 against the bias of the spring 75. This will move the slides 63 and 64 and thus the arms 7 and 71 and associated gripping members 69 and 72 relatively towards each other to engage and grip cards in the stack 26. The arrangement of the slides 63 and 64 which slide along the arm 62 during this movement will ensure that equal and opposite gripping forces are exerted on the cards. Thus, if one gripping member 69 or 72 contacts one side of the cards first so that its associated slide stops moving, the other gripping member 69 or 72 will be moved inwardly to grip the opposite side of the cards. When the current supply to the solenoid 73 ceases, the spring 75 will urge the slides 63 and 64 apart and the gripping members 69 and 72 away from opposite sides of the cards. Engagement of the slides 63 and 64 with its adjacent stop 66 will ensure that both gripping members 69 and 72 are moved away from opposite sides of the cards. For example, if the slide 63 first engages a stop 66, the spring 75 will urge the body of the solenoid 73 and connected arm 71 and gripping member 72 away from the cards. The gripping members 69 and 72 are preferably provided with gripping pads 77 of rubber or other material with similar properties to enhance the grip of the cards. As an alternative to the gripping members 69 and 72, the arms 67 and 71 may support in place of the members 69 and 72, inwardly directing thin fingers or pins 78 (shown in dotted outline in FIG. 5) which when the solenoid 73 is actuated move into the stack 26 between respective cards to split the stack 26.

Each roller assembly is in the form of a shaft or axle supported at the opposite side walls 11 in bearings or the like. The shafts of the roller assemblies 20, 21, 44, 45, 46 and 49 extend beyond one side wall 11 and carry respective pulleys 79, 80, 81, 82, 83 and 84 respectively about which an endless belt 85 passes (see FIG. 1). The belt 85 also extends about a pulley 86 connected to the shaft of a drive motor 87. Respective idlers 88 and 89 guide the belt 85 to selected pulleys. The belt 85 is preferably a toothed belt for cooperation with teeth or grooves on the pulleys. It will be apparent in this arrangement that when the motor 87 is operated, drive will be transmitted through the belt 85 to the opposed roller assemblies 20 and 21 to cause them to be driven in contra-rotation.

Similarly, drive is transmitted to the opposed rollers 44 and 45 to effect contra-rotating movement thereof. Drive is also transmitted to the rollers 46 and 49 of the respective roller assemblies 41 and 42.

The roller assemblies 15 and 18 are arranged to be driven by means of a further motor 90 mounted to one side wall 11 and having its shaft extending through that side wall 11 into the interior of the apparatus 10. The shafts of the respective roller assemblies 15 and 18 and the shaft of the motor 90 carry pulleys about which an endless drive belt 91 passes, such that when the motor 90 is operated, the roller assemblies 15 and 18 are rotated in the same direction (anti-clockwise in FIG. 3).

A further motor 92 is provided to drive the roller assemblies 29 and 30 through a similar drive arrangement, namely pulleys on the shaft of each roller assembly 29 and 30 and on the shaft of the motor 92 interconnected by means of an endless belt 93. When the motor 92 is operated, the roller assemblies 29 and 30 are driven simultaneously in the same direction (clockwise in FIG. 3). Of course, the motors 91 and 92 may be coupled to the respective roller assemblies by gears or any other transmission arrangement. A further motor 94 is coupled to the pulley 58 such that when operated drive is transmitted to the pulley 58 and thus to the belt 59 to cause movement of the card gripping mechanism 56 along the track 61 and thus along the stack of cards 26.

A programmable control unit 95 is provided to control operation of the apparatus 10 and the drive motors thereof in accordance with conditions sensed in the apparatus. Thus, in addition to the sensor 53 at the card dispensing station 43, a further sensor 96 is provided to sense the presence of cards at the loading station 12 and a sensor 97 is provided to sense the presence of cards between the roller assemblies 20 and 21. A further sensor 98 is provided adjacent the roller assemblies 29 and 30 to sense cards passing out of the chamber 25.

In use, a stack of cards 14 or individual cards may be placed into the station 12 to be seated on the platform 13 and on the roller assembly 15, whilst a stack of cards 26 may be located within the chamber 25. A start switch is operated and the sensor 53, sensing the absence of cards in the dispensing station 43 will initiate through the control unit 95 operation of the apparatus 10 by causing the motors 92 and 87 to start. If a stack of cards 26 is located within the chamber 25, operation of the roller assemblies 29,30 will displace the lowermost card 33 from the stack 26 and supply it to the roller assemblies 40, 41 and 42 where it is gripped and conveyed to the dispensing station 43 as shown in dotted outline in FIG. 3. The sensor 98 senses movement of a card out of the chamber 25, and after a time delay, the control unit 95 will stop the motor 93 operating to prevent more than one card being conveyed to the dispensing station 43, whilst the sensor 53, on sensing a card in the dispensing unit 43 will cause the control unit 95 to stop operation of the motor 87.

Figure 7:
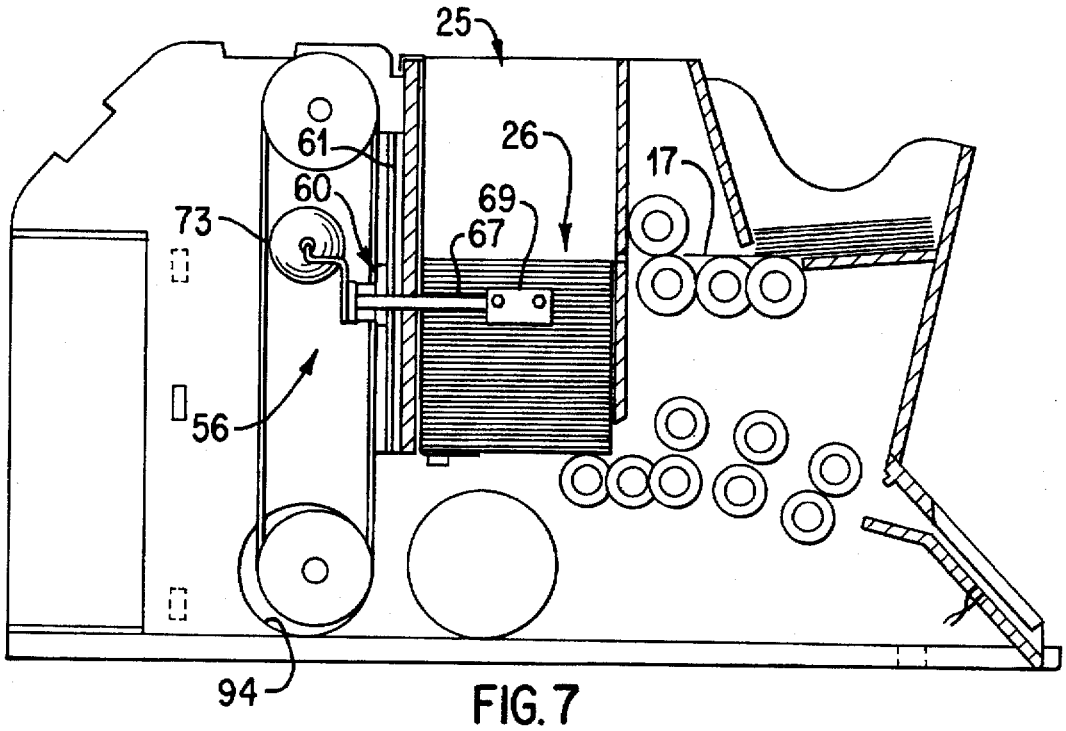
FIGS. 7 to 10 illustrate in elevational view the manner in which the apparatus operates.

When a card or stack of cards 14 are placed into the loading station 12, the sensor 96 on sensing the presence of those cards will cause the control unit 95 to operate the drive motor 90 to cause that card or lowermost card 17 in the stack 14 to be moved towards the chamber 25 due to rotation of the roller assemblies 15 and 18. The sensor 96 also causes the control unit 95 to operate the main drive motor 87 to drive the roller assemblies 20 and 21 which grip the card displaced from the station 12 by the roller assemblies 15 and 18. When the sensor 97 senses a card passing between the nip of the roller assemblies 20 and 21, it will cause the motor 90 to cease operation to prevent further cards being fed from the station 12. The sensor 96, on sensing cards at the station 12 will also commence operation of the motor 94 which drives the roller 58. Operation of the roller 58 causes the belt 59 to move the carriage 61 to a position along the stack 26 at which the motor 94 is stopped as shown in FIG. 7. At that position the solenoid 73 is actuated to move the arms 67 and 71 inwardly towards opposite sides of the stack 26 causing the gripping members 69 and 72 to engage and grip the cards at that position as described previously.

Figure 8:
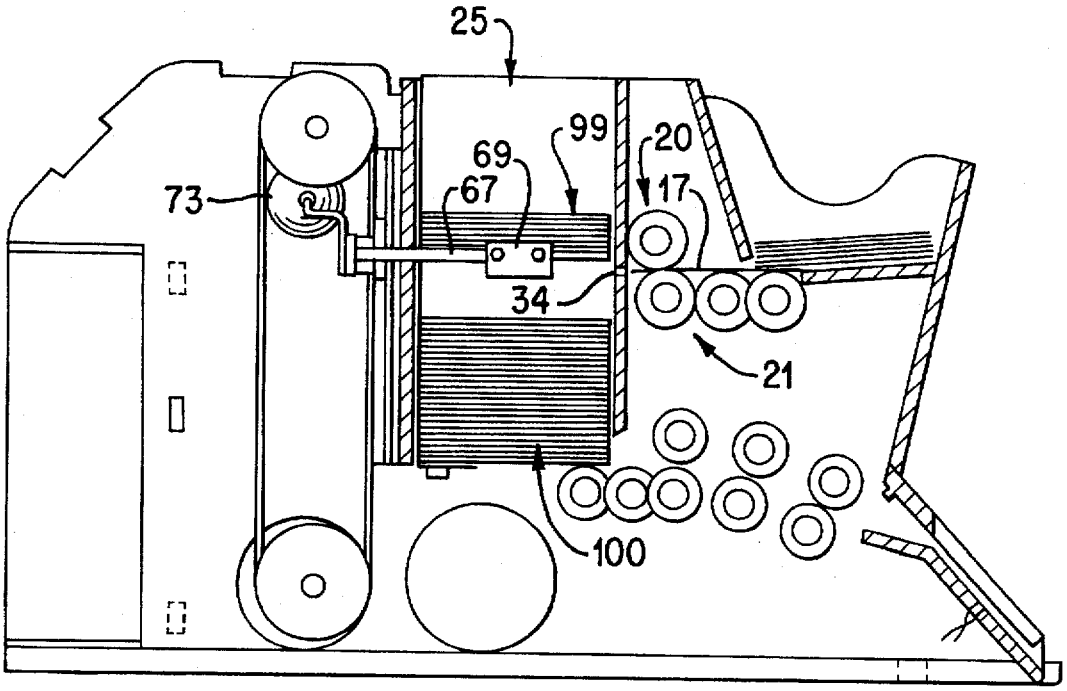
Figure 9:
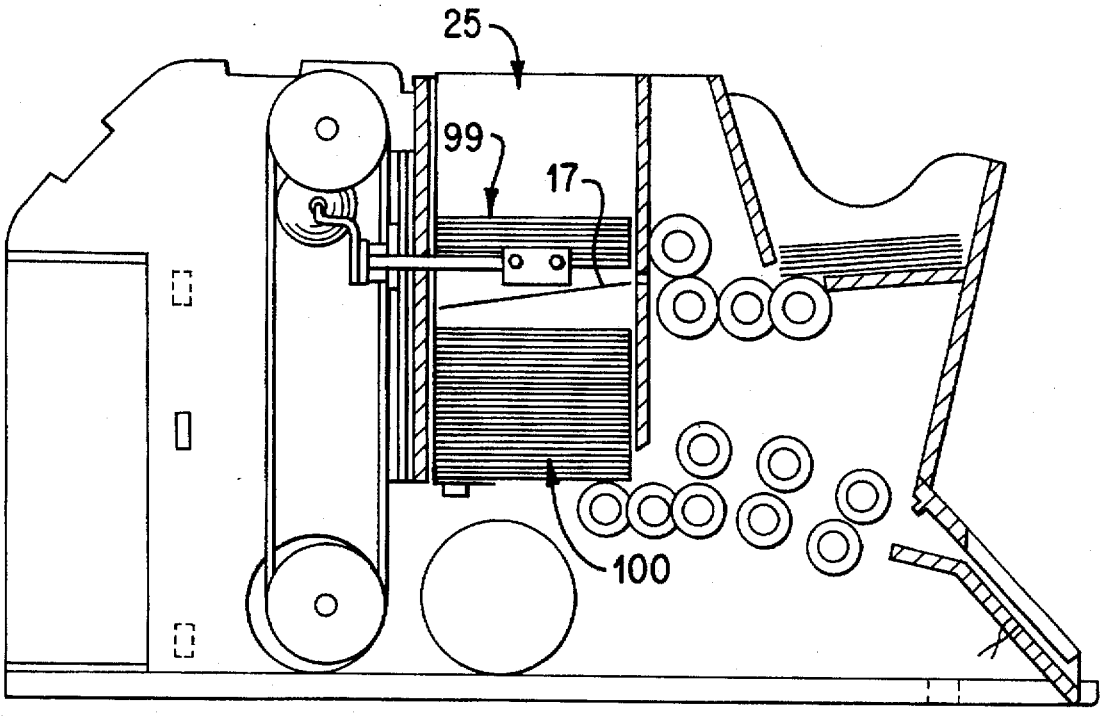
Figure 10:
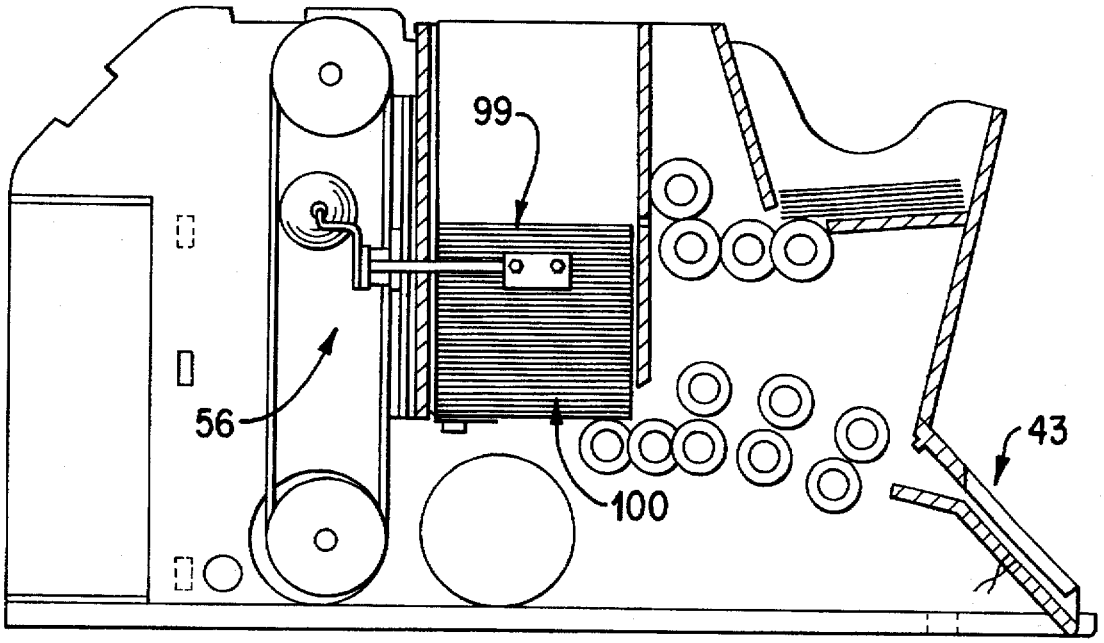

The motor 94 is then again operated to move the carriage 60 vertically to lift a sub-stack 99 of the stack 26 of the cards above the remainder 100 of the stack 26 and above the opening 34 as shown in FIG. 8. The card 17 displaced from the station 12 is moved by the roller assemblies 20 and 21 through the opening 34 and between the sub-stack 99 and remainder of the stack 100 as shown in FIG. 9. The card 17 thus drops onto the stack 100. The sensor 97 on sensing the passage of the card 17 into the chamber 25 will cause the control unit 96 after a time delay to operate the motor 94 in reverse and lower the sub-stack 99 onto the remainder 100 of the stack as shown in FIG. 10.

Alternatively or when the stack 99 is lowered, supply to the solenoid 73 is removed so that the spring 74 urges the arms 67 and 71 outwardly to release the sub-stack 99 of cards which drops onto or are released onto the inserted card 17 and stack 100 below it. The mechanism 56 is then returned to the position of FIG. 1. This procedure continues as cards are withdrawn from the dispensing station 43 whilst the apparatus remains on and cards are within the loading station 12. Each actuation of the motor 94, however, moves the carriage 60 and arms 67 and 71 to different or a set of positions along the stack 26, so that cards 17 introduced from the loading station 12 are placed within the stack 26 at different positions to effect shuffling.

Where the apparatus is used on a card game table for example in playing the game of blackjack, the dealer simply selects cards from the dispensing station 43 for dealing to each player. When respective cards are removed from the dispensing station 43, the apparatus 10 automatically operates to supply a further card from the lowermost end of the main stack 26 to the dispensing station 43 so that the dealer may select same. At the end of a round, the cards used are collected by the dealer and placed in a stack into the loading station 12. This will actuate the shuffling action with the cards in the loading station being moved one at a time into the main stack 26 and into different positions along the main stack as determined by the positions at which the card gripping and moving mechanism 56 grips and lifts the cards to create spaces in the main stack 26 to receive cards.

The positions at which the arms 67 and 71 are actuated to grip and lift the cards in the stack 26 may be a series of set positions or may be randomly selected positions. The series of set positions may be set by a member 101 having a series of vertically spaced apertures 102 therein. A light sensor 103 movable with the carriage 61 senses alignment with respective apertures 102 by sensing light passing therethrough to cause the motor 94 to cease operation. At one position, the arms 67 and 71 may be moved to lift the whole stack 26 to place the introduced card 17 at the head of the stack 26. Furthermore, the apparatus 10 may be operated to regularly place the introduced card 17 at the top of the stack 26. Of course, introducing a card at this position does not require lifting of the stack 26 or portions thereof. If the carriage 60 is stopped at random positions along the stack 26, the random positions are selected by the control unit 95.

The apparatus of the invention thus provides for a shuffling action of cards by means of loading of respective cards into random or selected positions into a stack with the cards being then dispensed from the lower end of the stack.

The apparatus described above is primarily used for handling and shuffling cards for playing card games. The apparatus, however, may be employed for shuffling or for the random selection of other planar members. Furthermore, whilst the stack has been shown in a vertical orientation, it may be arranged horizontally or in any other orientation such as in an inclined orientation. Means other than rollers may be provided for moving the cards from the respective stacks such as pushers. Movement of the roller 58 may be by means of any suitable drive mechanism such as stepper motors or accurately controlled motors of other forms with rotation thereof being achieved under the control of suitable electronic and/or programmable control means.

The carriage 60 may be moved by other actuating mechanisms such as by pneumatic rams or mechanical actuators and the arms 67 and 71 may be actuated by any suitable mechanisms.

The blocks 24 may be replaced by alternative card metering means such as a downwardly extending tongue of flexible material such as rubber which is arranged on the rear wall of the station 12 centrally of the cards. Additionally, the loading station 12 may be positioned with the base 12 inclined such that the displaced card 17 will contact the upper surface of the lower roller 23 below the nip between the roller assemblies 20 and 21. Thus when the roller assembly 15 is actuated, the lowermost card 17 will be displaced and engage the tongue 19 causing it to lift upwardly.

Further movement of the lowermost card 17 will cause it to engage the surface of the lower roller 23. This will cause the leading end of the displaced card 17 to lift upwardly so as to be gripped by both rollers 22 and 23. The tongue will also lift upwardly during this movement and then flex back to its original position after the displaced card 17 has passed.

The gripping arms 67 and 71 may be mounted to the carriage 60 for pivotal movement about a substantially vertical axis inwardly and outwardly relative to each other under the control of an actuating mechanism which may comprise the solenoid 73. Actuation of the solenoid will pivot the arms 67 and 71 towards opposite sides of the stack 26 of cards to grip or split same.

The apparatus has been described for use in playing card games where single cards at any one time are drawn from the station 43. The apparatus 10 however may shuffle and supply a single or multiple packs of cards. For this purpose, control of the apparatus 10 is varied such that, the apparatus 10 will continue operate to shuffle cards and supply a full pack of cards at the station 43. This may be achieved by overriding operation of the sensor 53 such that the feed rollers 29 and 30 and roller assemblies 41, 42 and 43 continue to operate such that cards in the chamber 25 are continually fed to the dispensing station 43 or equivalent receiving chamber until a pack of shuffled cards is obtained.

The apparatus of the present invention is particularly applicable for shuffling playing cards for use in playing card games. The apparatus, however, is also equally applicable to shuffling and handling other similarly thin planar members, and thus the term "card" as used throughout the specification and claims includes playing cards and all other similarly thin planar members.

The above has been given by way of illustrative embodiment of the invention however, all such modifications and variations thereto as would be apparent to persons skilled in the art are deemed to fall within the broad scope and ambit of the invention as defined in the appended claims.

We claim:

1. A card handling apparatus including:

housing means;

means for supporting a main stack of cards in said housing means;

means for engaging cards in said main stack at a series of positions along said main stack and for moving said engaged cards longitudinally of said main stack to separate said cards at respective ones of said positions into first and second sub-stacks;

means for introducing further cards into said main stack at said respective positions between said first and second sub-stacks; and means adjacent one end of said main stack for removing cards from said main stack for dispensing thereof.

2. Card handling apparatus according to claim 1 and including a loading station for supporting a further card or cards for introduction into said main stack, and means for moving said further card or cards into said main stack.

3. Card handling apparatus according to claim 2 wherein said moving means includes a roller adapted to engage a said further card whereby when said roller is rotated, said further card is displaced towards said main stack.

4. Card handling apparatus according to claim 2 and including a pair of opposed co-operating rollers for engaging said further card and for moving said further card into said main stack.

5. Card handling apparatus according to claim 1 where said main stack is supported substantially vertically and wherein said card engaging means is adapted to lift said engaged cards above the underlying card in said main stack to form said sub-stacks.

6. Card handling apparatus according to claim 1 wherein said card engaging means includes means for gripping opposite sides of some of said cards in said main stack.

7. Card handling apparatus according to claim 6 wherein said gripping means includes a pair of gripping arms adapted to be located on opposite sides of said main stack, said arms being supported for movement towards and away from cards in said main stack.

8. Card handling apparatus according to claim 7 wherein said card engaging means includes a carriage for supporting said arms, and means for moving said carriage to said positions along said main stack at which cards are gripped by said gripping means.

9. Card handling apparatus according to claim 8 wherein said carriage is supported for movement along a guide track extending longitudinally of said main stack and wherein said moving means includes a belt coupled to said carriage.

10. Card handling apparatus according to claim 9 wherein said belt comprises an endless belt supported about spaced apart rollers, said belt being movable upon rotation of said rollers to cause movement of said carriage along said guide track.

11. Card handling apparatus according to claim 8 wherein said carriage supports a guide arm extending transversely of said main stack, and wherein said gripping arms are connected to slides movable along said guide arm, and actuating means connected between said slides for moving said arms towards and away from said main stack of cards.

12. Card handling apparatus according to claim 11 and including biasing means for biasing said arms to a position away from said main stack of cards and wherein said actuating means are operable to move said arms against the bias of said biasing means.

13. Card handling apparatus according to claim 7 wherein said gripping arms include gripping members for gripping of cards in said main stack.

14. Card handling apparatus according to claim 1 wherein said main stack of cards are adapted to be supported substantially vertically at least partially on roller means, said roller means being rotatable to remove cards from said main stack for dispensing thereof.

15. Card shuffling apparatus, said apparatus including:

a housing;

means for supporting a main stack of cards in a substantially upright attitude in said housing;

means in said housing for supporting a secondary stack of cards comprising one or more cards for introduction into said main stack of cards;

means adjacent said main stack for lifting at least some of said cards from a remainder of said cards in said main stack at a series of positions along said main stack to form first and second sub-stacks; and means for introducing respective cards from said secondary stack into said main stack at respective ones of said positions between said first and second sub-stacks.

16. Card shuffling apparatus according to claim 15 wherein said means for lifting said at least some of said cards comprises means for gripping opposite sides of said at least some of said cards.

17. Card shuffling apparatus according to claim 15 wherein said means for lifting said at least some of said cards comprises means for insertion into said main stack of cards.

18. Card shuffling apparatus according to claim 15 wherein said card introducing means includes roller means adapted when rotated to move a card or respective lowermost cards from said secondary stack into said main stack.

19. Card shuffling apparatus according to claim 15 and including means for removing or displacing cards from said main stack.

20. Card shuffling apparatus according to claim 19 wherein said card removing means including roller means, said main stack being supported at its lower end at least partially on said roller means, said roller means being operable to remove or displace the respective lowermost cards in said main stack.

21. Card shuffling apparatus according to claim 19 and including a dispensing station for receiving said cards removed or displaced from said main stack, means for sensing cards in said dispensing station and means for causing displacement of cards from said main stack for dispensing when absence of cards in said dispensing station is sensed.

22. Card shuffling apparatus according to claim 15 and including means for sensing cards in said secondary stack and for causing operation of said separating means and card introducing means when cards are sensed in said secondary stack.

23. Card shuffling apparatus according to claim 15 wherein said separating means is operable to move said first and second sub-stacks back towards each other after introduction of a card from said secondary stack therebetween.

* * * * *